166-307 SR
7/5/83 OR 4,391,327

United States Patent [19] [11] 4,391,327
De Carlo [45] Jul. 5, 1983

[54] SOLVENT FOAM STIMULATION OF COAL DEGASIFICATION WELL

[75] Inventor: Leonard J. De Carlo, Morgantown, W. Va.

[73] Assignee: Conoco Inc., Ponca City, Okla.

[21] Appl. No.: 262,575

[22] Filed: May 11, 1981

[51] Int. Cl.[3] ..... E21B 43/26; E21B 43/27
[52] U.S. Cl. ..... 166/307; 44/1 B; 166/308; 299/12
[58] Field of Search ..... 166/259, 271, 307, 308, 166/309; 299/5, 12; 44/1 B

[56] References Cited

U.S. PATENT DOCUMENTS

| | | | |
|---|---|---|---|
| 3,384,416 | 5/1968 | Ruehl et al. | 166/308 |
| 3,572,439 | 3/1971 | Hutchison et al. | 166/309 |
| 3,572,440 | 3/1971 | Hutchison et al. | 166/307 X |
| 3,850,477 | 11/1974 | Aldrich et al. | 166/307 X |
| 3,990,513 | 11/1976 | Perch | 44/1 B X |
| 4,030,893 | 6/1977 | Keller | 44/1 B |
| 4,032,193 | 6/1977 | Drinkard et al. | 166/307 X |
| 4,044,833 | 8/1977 | Volz | 166/307 |
| 4,130,164 | 12/1978 | Datta | 166/259 |
| 4,253,703 | 3/1981 | Fonsela et al. | 299/5 |
| 4,301,868 | 11/1981 | Scherubel et al. | 166/308 |

FOREIGN PATENT DOCUMENTS

| | | | |
|---|---|---|---|
| 248601 | 12/1969 | U.S.S.R. | 299/5 |

OTHER PUBLICATIONS

Clark et al., "The Use of Fluorochemical Surfactants in Non-Aqueous Stimulation Fluids," SPE 7894, Jul. 18, 1979.

*Primary Examiner*—Stephen J. Novosad
*Assistant Examiner*—George A. Suchfield
*Attorney, Agent, or Firm*—Richard W. Collins

[57] ABSTRACT

A foamed fluid containing a coal solvent is injected into a coal seam to improve the gas permeability of the coal.

5 Claims, 1 Drawing Figure

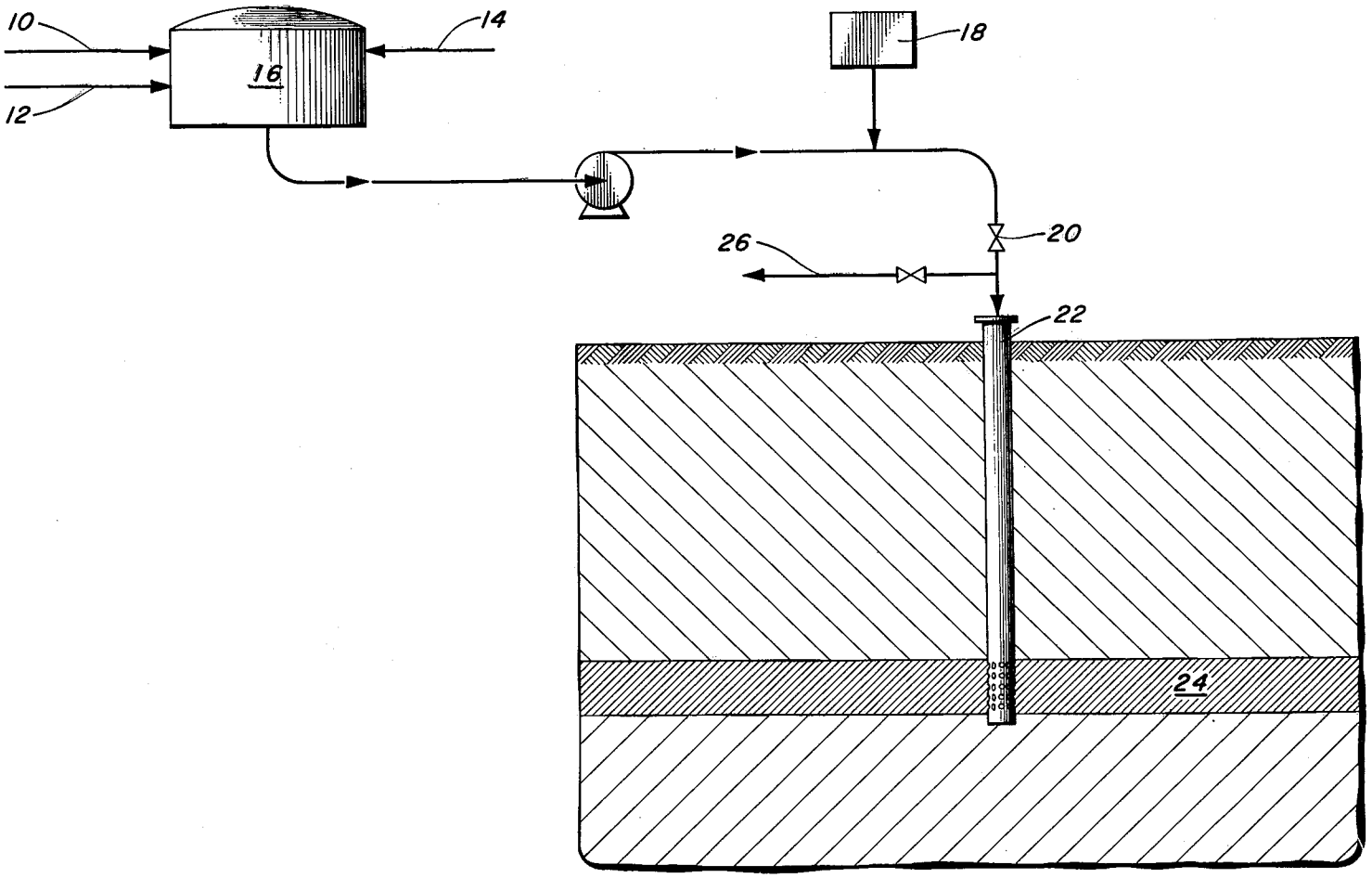
10
12
14
16
18
20
22
24
26

SOLVENT FOAM STIMULATION OF COAL DEGASIFICATION WELL

BACKGROUND OF THE INVENTION

This invention relates to degasification of coal seams, and more particularly to an improved method of treating a coal seam to increase the gas permeability thereof. Many coal seams contain methane and other undesirable gases which create a mining hazard. Several methods are currently in use to reduce the amount of undesirable gases in coal seams in advance of mining.

U.S. Pat. No. 4,043,395 describes a process for removing methane from a coal seam in which a carbon dioxide-containing fluid is introduced into the coal deposit and held therein for a period sufficient to enable a substantial amount of methane to be desorbed from the surfaces of the coal. Following the holding period, the injected fluid and desorbed methane are recovered from the coal seam.

U.S. Pat. No. 3,384,416 describes a method of fracturing and degassing of coal seams by injecting a volatile liquid into the coal seam to fracture it. The pressure is then released and the volatile material and coal seam gas are withdrawn from the fractured coal seam.

U.S. Pat. No. 1,867,758 describes an early technique for degasifying coal seams by forming a tunnel system through the seam and applying a partial vacuum to the tunnel system.

U.S. Pat. Nos. 3,650,564 and 3,934,649 describe drilling processes for degasifying coal seams. The processes described in these patents are not particularly pertinent to the process of the present invention, but they are mentioned to emphasize the extent of work that has been carried out to effect degasification of coal seams.

U.S. Pat. No. 4,044,833 describes a method of fracturing a subterranean formation using an acid foam as the fracturing fluid.

U.S. Pat. No. 4,126,181 describes an improved method of fracturing a subterranean formation using a foam.

U.S. Pat. No. 4,080,419 describes a process for leaching fragmented ore with a reagent-carrying foam.

It has been proposed to inject a coal solvent into a coal seam to partially dissolve the coal, particularly around the existing fractures in the coal, to improve gas permeability from the coal seam.

While numerous techniques have been utilized in the past for degasifying coal seams, these techniques, while successful to varying degrees, have all had shortcomings. Drilling of degasification boreholes through the coal seams is time consuming, expensive, and difficult. Fracturing of coal seams can be effective, but can weaken a mine roof structure with subsequent hazards to the mining operation. Injection of a coal solvent requires a great deal of expensive solvent, and the injected solvent is difficult to recover. Thus, there has been a continuing need for improvements.

SUMMARY OF THE INVENTION

According to the present invention, a foamed fluid containing a coal solvent is injected into a coal seam to improve the gas permability of the coal and to increase the potential rate of gas drainage from the coal seam. The coal solvent is preferably mixed with a diluent and a foam-producing surfactant. A high pressure gas is added to the mixture which is then injected as a dense foam into a coal seam. The solvent in the foam creates new passages and enlarges existing passages in the coal seam thereby improving the gas drainage characteristics of the coal seam.

BRIEF DESCRIPTION OF THE DRAWINGS

The FIGURE is a schematic illustration of the process according to the invention.

DESCRIPTION OF THE PREFERRED EMBODIMENT

The present invention will now be described with reference to the FIGURE. A liquid coal solvent from line 10, a diluent from the solvent from line 12, and a surfactant from line 14 are blended in mixing tank 16. The blended material in liquid form from tank 16 is combined with a high pressure gas from gas source 18. The combined liquid and high pressure gas are introduced through injection valve 20 into well 22 extending from the surface to coal seam 24.

The foamed solvent-containing fluid passes from well 22 into coal seam 24. If the injection pressure is less than the fracturing pressure of the coal seam, the fluid will flow into existing fractures or passages in the coal, and to some extent the action of the solvent will create new passages. Following injection of the foamed solvent, the well is preferably closed in for a period of time to allow the solvent to work on the coal which it contacts. Normally, at least 0.5 hours of shut-in time is utilized. Following the shut-in time, the well is opened for flow and the injected gas as well as naturally occurring gas in the coal seam is produced from production line 26.

The solvent can be any liquid with coal dissolving properties. Many such liquids are known, including toluene, pyridine, xylene, tetralin, anthracene, and coal tar. Selection of a particular solvent or mixture of solvents depends on such things as availability, price, handling ease, etc.

It will generally be desirable to use a diluent for the solvent to improve its handling characteristics. For most coal solvents, an aliphatic alcohol having from 1 to 4 carbon atoms is a preferred diluent.

A foam-producing surfactant is required. Preferred surfactants are 10 to 12 carbon alcohols with propylene oxide or ethylene oxide groups attached to the structure. However, any foam producing surfactant may be used.

Normally, the process will be carried out using an injection pressure less than the fracturing pressure of the formation to avoid damage to the overlying structure which will subsequently form the mine roof. However, the use of injection pressures above the fracturing pressure of the coal seam is contemplated, and in some cases is desirable.

In most cases where formation fracturing pressures are utilized, and in some cases where pressures below formation fracturing pressure are utilized, a propping agent such as sand may be included in the injected material.

The high pressure gas is preferably an inert gas or air, although in some cases low molecular weight hydrocarbons or other volatile organic materials may be used. A preferred source of gas is liquified nitrogen for reasons of safety, economy, and convenience.

The primary advantage of the process of this invention over injecting a liquid coal solvent into the coal seam is that a much smaller amount of solvent is required. Also, the solvent in the form of a foam is more mobile and a larger area can be effectively treated. Additionally, production of gas from the treatment well can be commenced as soon as the injected foam has broken. In most cases, the injected foam will break within less than one hour at formation temperature and pressure.

The foregoing description is intended to be illustrative rather than limiting of the invention. It will be apparent that numerous variations and modifications to the process as described could be utilized without departing from the invention, which is defined by the appended claims.

I claim:

1. A method for improving the gas drainage characteristics of a coal seam comprising:

(a) injecting into said coal seam a foamed fluid comprised of a liquid solvent selected from the group consisting of toluene, pyridine, xylene, tetralin, anthracene, coal tar and mixtures thereof, a foam-producing surfactant and a high pressure gas, said foamed fluid containing an amount of said solvent effective to partially dissolve coal contacted by said foamed fluid;

(b) maintaining said foamed fluid in contact with said coal seam for a period of time sufficient for said solvent to partially dissolve coal contacted therewith thereby improving the gas drainage characteristics of said coal seam; and (c) recovering injected material and naturally occurring gas from said coal seam.

2. The method of claim 1 wherein said foamed fluid is injected into said coal seam at a pressure less than its fracturing pressure.

3. The method of claim 1 wherein said foamed fluid is injected through an injection well extending into said coal seam, after said fluid is injected said well is shut in for a period of at least 0.5 hours, and said well is then opened for flow from said coal seam.

4. The method of claim 1 wherein said foamed fluid contains a solvent diluent selected from the group consisting of alcohols having from 1 to 4 carbon atoms.

5. The method of claim 1 wherein said gas is selected from the group consisting of inert gases and air.

* * * * *